US008601820B2

(12) United States Patent
Byrne et al.

(10) Patent No.: US 8,601,820 B2
(45) Date of Patent: Dec. 10, 2013

(54) INTEGRATED LATE LEAN INJECTION ON A COMBUSTION LINER AND LATE LEAN INJECTION SLEEVE ASSEMBLY

(75) Inventors: William Byrne, Greenville, SC (US); Patrick Benedict Melton, Greenville, SC (US); David William Cihlar, Greenville, SC (US); Lucas Stoia, Greenville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/153,944

(22) Filed: Jun. 6, 2011

(65) Prior Publication Data

US 2012/0304648 A1 Dec. 6, 2012

(51) Int. Cl.

| | |
|---|---|
| ***F02C 3/00*** | (2006.01) |
| ***F02C 7/22*** | (2006.01) |
| *F02C 1/04* | (2006.01) |
| *F02C 7/224* | (2006.01) |

(52) U.S. Cl.
USPC ..... 60/754; 60/752; 60/738

(58) Field of Classification Search
USPC ..... 60/752, 754, 758–760, 733, 738, 776, 60/735, 737
See application file for complete search history.

(56) References Cited

U.S. PATENT DOCUMENTS

| | | | |
|---|---|---|---|
| 3,055,179 | A | 9/1962 | Lefebvre et al. |
| 3,099,134 | A | 7/1963 | Calder et al. |
| 3,872,664 | A | 3/1975 | Lohmann et al. |
| 3,924,576 | A | 12/1975 | Siewert |
| 3,934,409 | A | 1/1976 | Quillevere et al. |
| 4,028,888 | A | 6/1977 | Pilarczyk |
| 4,192,139 | A | 3/1980 | Buchheim |
| 4,236,378 | A | 12/1980 | Vogt |
| 4,265,615 | A | 5/1981 | Lohmann et al. |
| 4,271,674 | A | 6/1981 | Marshall et al. |
| 4,420,929 | A | 12/1983 | Jorgensen et al. |
| 4,543,894 | A | 10/1985 | Griswold et al. |
| 4,590,769 | A | 5/1986 | Lohmann et al. |
| 4,603,548 | A | 8/1986 | Ishibashi et al. |
| 4,614,082 | A * | 9/1986 | Sterman et al. ..... 60/796 |
| 4,872,312 | A | 10/1989 | Iizuka et al. |
| 4,928,481 | A | 5/1990 | Joshi et al. |
| 4,955,191 | A | 9/1990 | Okamoto et al. |
| 4,989,549 | A | 2/1991 | Korenberg |
| 4,998,410 | A | 3/1991 | Martinez-Leon et al. |
| 5,054,280 | A | 10/1991 | Ishibashi et al. |
| 5,076,229 | A | 12/1991 | Stanley |
| 5,099,644 | A | 3/1992 | Sabla et al. |
| 5,127,229 | A | 7/1992 | Ishibashi et al. |
| 5,259,184 | A | 11/1993 | Borkowicz et al. |
| 5,274,991 | A | 1/1994 | Fitts |
| 5,323,600 | A | 6/1994 | Munshi |
| 5,350,293 | A | 9/1994 | Khinkis et al. |

(Continued)

*Primary Examiner* — Ehud Gartenberg
*Assistant Examiner* — Karthik Subramanian
(74) *Attorney, Agent, or Firm* — Nixon & Vanderhye PC

(57) ABSTRACT

A late lean injection sleeve assembly allows the injection of fuel at the aft end of a gas turbine liner, before the transition piece, into the combustion gases downstream of a turbine combustor's fuel nozzles. The late lean injection enables fuel injection downstream of the fuel nozzles to create a secondary/tertiary (with quaternary injection upstream of the fuel nozzles) combustion zone while reducing/eliminating the risk of fuel leaking into the combustor discharge case. The fuel is delivered by the flow sleeve into one or more nozzles that mix the fuel with CDC air before injecting it into the combustor's liner.

29 Claims, 10 Drawing Sheets

(56) References Cited

U.S. PATENT DOCUMENTS

| | | | | |
|---|---|---|---|---|
| 5,394,688 | A | 3/1995 | Amos | |
| 5,408,825 | A | 4/1995 | Foss et al. | |
| 5,450,725 | A | 9/1995 | Takahara et al. | |
| 5,479,782 | A | 1/1996 | Parker et al. | |
| 5,481,866 | A | 1/1996 | Mowill | |
| 5,518,395 | A | 5/1996 | Maughan | |
| 5,623,819 | A | 4/1997 | Bowker et al. | |
| 5,638,674 | A | 6/1997 | Mowill | |
| 5,640,851 | A | 6/1997 | Toon et al. | |
| 5,647,215 | A | 7/1997 | Sharifi et al. | |
| 5,657,632 | A | 8/1997 | Foss | |
| 5,687,571 | A | 11/1997 | Althaus et al. | |
| 5,749,218 | A | 5/1998 | Cromer et al. | |
| 5,749,219 | A * | 5/1998 | DuBell | 60/804 |
| 5,802,854 | A | 9/1998 | Maeda et al. | |
| 5,826,429 | A | 10/1998 | Beebe et al. | |
| 5,829,967 | A | 11/1998 | Chyou | |
| 5,850,731 | A | 12/1998 | Beebe et al. | |
| 5,878,566 | A | 3/1999 | Endo et al. | |
| 6,047,550 | A | 4/2000 | Beebe | |
| 6,092,363 | A | 7/2000 | Ryan | |
| 6,182,451 | B1 | 2/2001 | Hadder | |
| 6,192,688 | B1 | 2/2001 | Beebe | |
| 6,289,851 | B1 | 9/2001 | Rabovitser et al. | |
| 6,343,462 | B1 | 2/2002 | Drnevich et al. | |
| 6,418,725 | B1 | 7/2002 | Maeda et al. | |
| 6,513,334 | B2 | 2/2003 | Varney | |
| 6,609,493 | B2 | 8/2003 | Yamaguchi et al. | |
| 6,663,380 | B2 | 12/2003 | Rabovitser et al. | |
| 6,705,117 | B2 | 3/2004 | Simpson et al. | |
| 6,775,987 | B2 | 8/2004 | Sprouse et al. | |
| 6,868,676 | B1 | 3/2005 | Haynes | |
| 7,040,094 | B2 | 5/2006 | Fischer et al. | |
| 7,082,770 | B2 | 8/2006 | Martling et al. | |
| 7,149,632 | B1 | 12/2006 | Gao et al. | |
| 7,185,497 | B2 | 3/2007 | Dudebout et al. | |
| 7,198,483 | B2 | 4/2007 | Bueche et al. | |
| 7,302,801 | B2 | 12/2007 | Chen | |
| 7,303,388 | B2 | 12/2007 | Joshi et al. | |
| 7,685,823 | B2 | 3/2010 | Martling et al. | |
| 7,757,491 | B2 | 7/2010 | Hessler | |
| 2001/0049932 | A1 | 12/2001 | Beebe | |
| 2003/0010035 | A1 | 1/2003 | Farmer et al. | |
| 2003/0024234 | A1 | 2/2003 | Holm et al. | |
| 2007/0234733 | A1 | 10/2007 | Harris et al. | |
| 2008/0072599 | A1 | 3/2008 | Morenko et al. | |
| 2008/0264033 | A1 | 10/2008 | Lacy et al. | |
| 2009/0019855 | A1* | 1/2009 | Venkataraman et al. | 60/738 |
| 2009/0084082 | A1 | 4/2009 | Martin et al. | |
| 2009/0126368 | A1* | 5/2009 | Patel et al. | 60/739 |
| 2009/0223228 | A1* | 9/2009 | Romoser | 60/776 |
| 2010/0018208 | A1* | 1/2010 | Ritland | 60/737 |
| 2010/0018209 | A1* | 1/2010 | Ramier et al. | 60/740 |
| 2010/0024425 | A1* | 2/2010 | Cihlar et al. | 60/734 |
| 2010/0071376 | A1* | 3/2010 | Wiebe et al. | 60/740 |
| 2010/0115966 | A1* | 5/2010 | Nagai et al. | 60/800 |
| 2010/0170216 | A1 | 7/2010 | Venkataraman et al. | |
| 2010/0170219 | A1 | 7/2010 | Venkataraman et al. | |
| 2010/0170251 | A1 | 7/2010 | Davis, Jr. et al. | |
| 2010/0170252 | A1 | 7/2010 | Venkataraman et al. | |
| 2010/0170254 | A1 | 7/2010 | Venkataraman et al. | |
| 2010/0174466 | A1 | 7/2010 | Davis, Jr. et al. | |

* cited by examiner

Flowsleeve Flange Manifold

Alternate Injector/
Transfer Tube Coupling

External View of Flowsleeve

Detail View of LLI Injector

INTEGRATED LATE LEAN INJECTION ON A COMBUSTION LINER AND LATE LEAN INJECTION SLEEVE ASSEMBLY

The present invention relates to turbines, and more particularly, to integrating a late lean injection into the combustion liner of a gas turbine and to a late lean injection sleeve assembly.

BACKGROUND OF THE INVENTION

Multiple designs exist for staged combustion in gas turbines, but most are complicated assemblies consisting of a plurality of tubing and interfaces. One kind of staged combustion in gas turbines is late lean injection ("LLI") where the LLI injectors of the air/fuel mixture are located in a combustor far down stream to achieve improved NOx performance. NOx, or oxides of nitrogen, is one of the primary undesirable air polluting emissions produced by some gas turbines which burn conventional hydrocarbon fuels. The late lean injection is also used as an air bypass, which is useful to meet carbon monoxide or CO emissions during "turn down" or low load operation.

Current late lean injection assemblies are expensive and costly for both new gas turbine units and retrofits of existing units due to the number of parts and the complexity of the fuel passages. Current late lean injection assemblies also have a high risk for fuel leakage into the compressor discharge casing, which can result in auto-ignition and be a safety hazard.

BRIEF DESCRIPTION OF THE INVENTION

The present invention is directed to a late lean injection sleeve assembly, which combines the traditional liner and flow sleeve assemblies into an assembly with an internal fuel manifold and an air/fuel delivery system. The liner and flow sleeve assembly allows for reduced leakage and improved control of potential fuel leakage. The fuel required for late lean injection is supplied to the sleeve via a manifold ring in the flow sleeve flange. Single feed holes are drilled through the flow sleeve. The fuel is delivered through at least one passage in the flow sleeve into nozzles or injectors that mix the fuel with compressor discharge case ("CDC") air before injecting it into the liner. Preferably, the at least one passage is one or more longitudinally extending holes or tubes in the flow sleeve, although a flow sleeve having co-annular walls could also be used to deliver the fuel to the nozzles or injectors. The number and size of nozzles/injectors can be varied, depending on the fuel supply requirement. The nozzles/injectors span both the flow sleeve and liner assemblies, providing a central core of late lean injection without air losses and potential fuel leakages.

The present invention is also directed to a late lean injection system in which the delivery of fuel is achieved via a combustor assembly in which the combustor's traditional flow sleeve and liner assemblies are combined into a single component with an internal fuel manifold and delivery system.

The late lean injection sleeve assembly allows the injection of fuel at the aft end of a gas turbine liner, before the transition piece, into the combustion gases downstream of the fuel nozzles. The late lean injection enables fuel injection downstream of the fuel nozzles to create a combustion zone downstream before the turbine's transition piece, while reducing/eliminating the risk of fuel leaking into the combustor discharge case. The late lean injection sleeve assembly is easily retrofitted into existing turbine units and is easily installed into new units. It reduces the risk of fuel leaking into the CDC compartment by not having any non-welded interfaces.

The present invention is further directed to integrated late lean injection on a combustion liner, which provides a simple low cost option for late lean injection. This integrated late lean injection design is easily retrofitted on existing units and can be installed at a lower cost than current late lean injection designs. The design is a single assembly that is installed during unit assembly. The design has a forward flange that is used for both support and to feed the fuel to the injection tubes at the aft end of the liner. Fuel is supplied to an internal manifold in the forward flange and is then delivered to the injection tubes through the struts. The number and orientation of the struts can be varied depending on the amount of late lean injection that is required. The axial running tubes are supported along the length of the liner by struts that are welded to the liner body. This interface is designed to minimize wear between the tube struts and the tubes. Other means of transferring fuel from the manifold flange along the outside of the liner to the nozzles could also be used. This can be achieved by fittings into the flange manifold, as opposed to using struts.

DETAILED DESCRIPTION OF THE INVENTION

Figure 1:
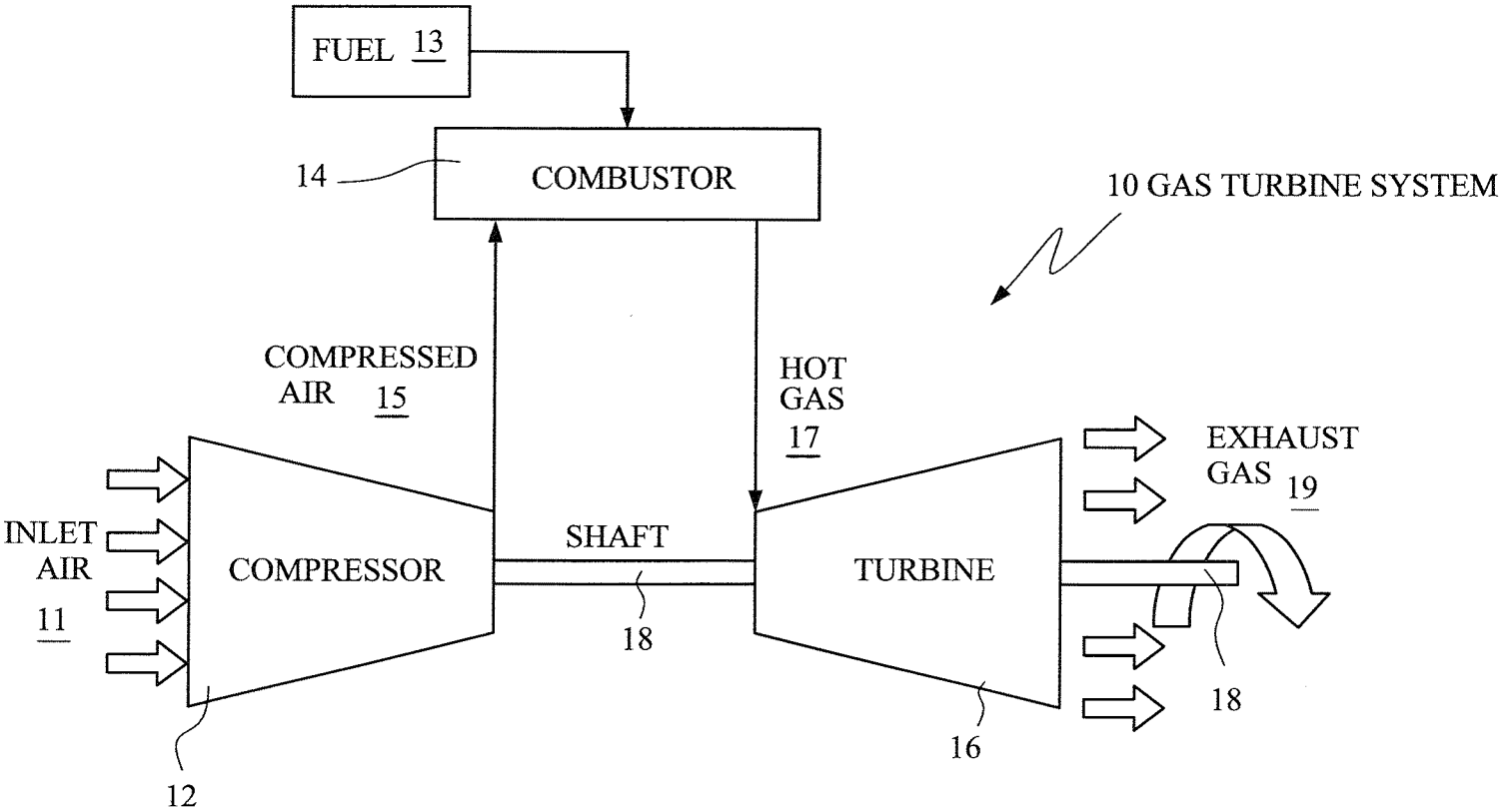
FIG. 1 (PRIOR ART)
FIG. 1 is a simple diagram showing the components of a typical gas turbine system.

FIG. 1 is a simple diagram showing the components of a typical gas turbine system 10. The gas turbine system 10 includes a compressor 12, which compresses incoming air 11 to high pressure, a combustor 14, which burns fuel 13 so as to produce a high-pressure, high-velocity hot gas 17, and a turbine 16, which extracts energy from the high-pressure, high-velocity hot gas 17 entering the turbine 16 from the combustor 14 using turbine blades (not shown), so as to be rotated by the hot gas 17. As the turbine 16 is rotated, a shaft 18 connected to the turbine 16 is caused to be rotated as well. Finally, exhaust gas 19 exits the turbine 16.

Figure 2:
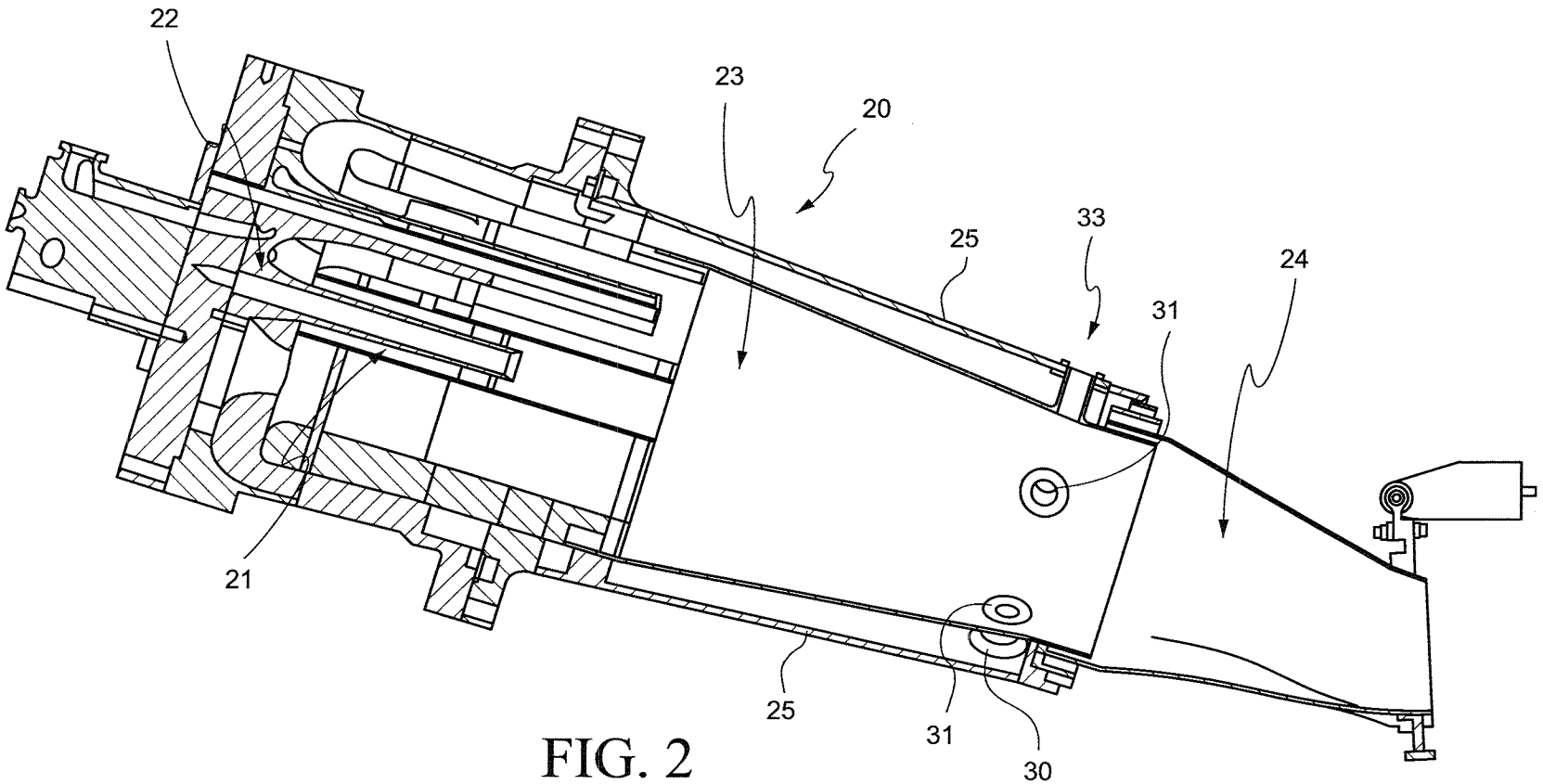
FIG. 2 is a partial side sectional view of a turbine combustor including a late lean injection system according to the present invention.

FIG. 2 is a partial side sectional view of a gas turbine combustor 20 including a late lean injection system according to the present invention. The combustor (combustor 14 in FIG. 1) includes a head end 22, which includes multiple premixing fuel nozzles 21, and a liner 23, which is connected to the head end 22, and in which supplied fuel is combusted. The liner 23 defines the combustion zone of the combustor 20.

The liner 23 is surrounded by a flow sleeve 25 and concluded by a transition piece or zone 24 connected to the liner 23. Compressor 12 (not shown in FIG. 2) compresses inlet air 11 and provides the compressed air to the combustor 20, to the transition piece 24, and to turbine 16 (also not shown in FIG. 2).

As noted above, the turbine includes turbine blades, into which products of at least the combustion of the fuel in the liner 23 are received to power a rotation of the turbine blades. The transition piece directs the flow of combustion products into the turbine 16, where they turn the blades of the turbine and generate electricity. Thus, the transition piece 24 serves to couple the combustor 20 and the turbine 16. But, the transition piece 24 also includes a second combustion zone in which additional fuel supplied thereto and the products of the combustion of the fuel supplied to the liner 23 combustion zone are combusted.

As noted above, the turbine combustor shown in FIG. 2 includes a late lean injection system according to the present invention. The objectives of the late lean injection system are to locate the late lean injection system injectors far downstream for improved NOx performance of the turbine combustor, but not too far into the transition piece, so as to result in undesirable higher CO emissions. The late lean injection system of the present invention also allows the elimination of internal compressor discharge case ("CDC") piping, flexhoses, sealed connections, etc. It also provides a simple assembly for integrating late lean injection into the combustion liner of a gas turbine.

Figure 3A:
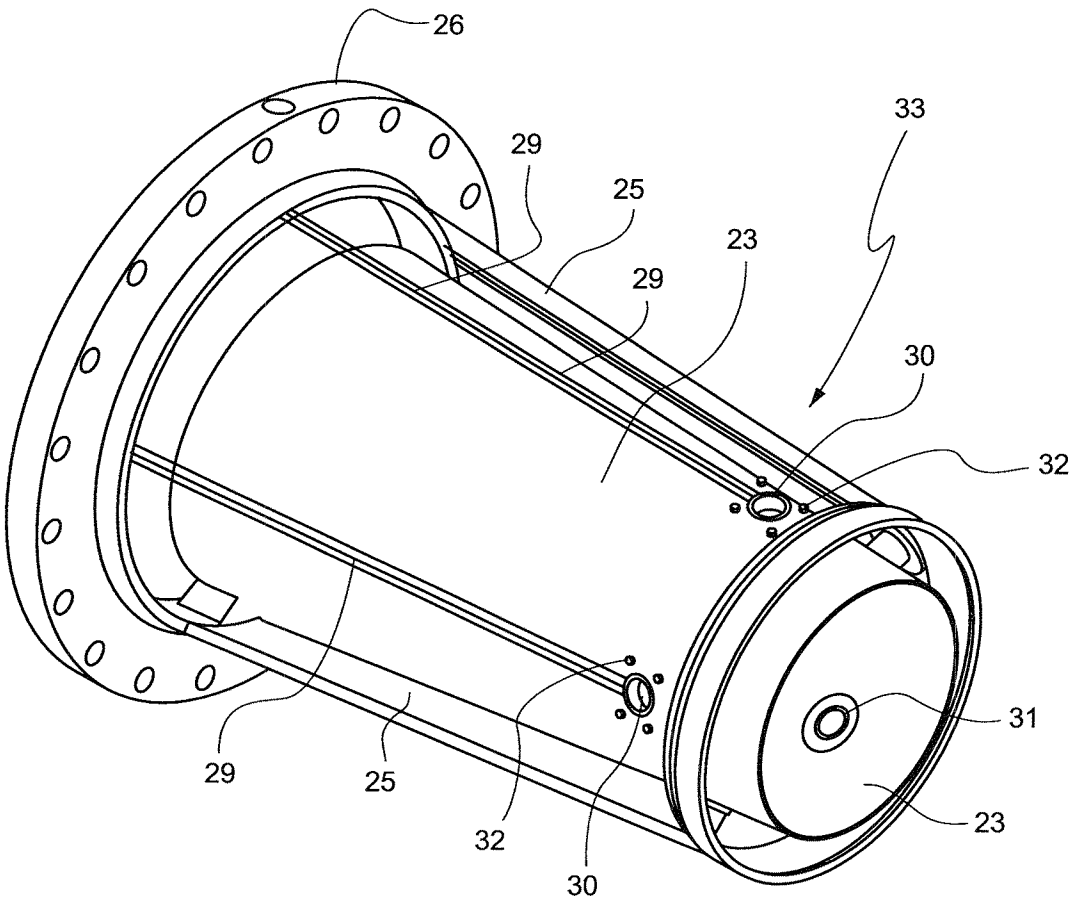
FIGS. 3A and 3B are a partial transparent perspective view and a side cross-sectional view, respectively, of a first embodiment of a flow sleeve for the late lean injection of fuel through a combustor liner.

FIG. 3A is a side perspective view of one embodiment of the late lean injection flow sleeve 25 for the injection of fuel at the aft end 33 of the liner 23, before the transition piece 24, into the combustion gases downstream of the head end 22 and the premixing fuel nozzles 21.

FIG. 3A shows that deep holes 29 are drilled axially and longitudinally through the flow sleeve 25 to the late lean injection ("LLI") nozzles/injectors 30 located at the aft/downstream end 33 of the liner 23. The liner 23 defines the combustion chamber where the combustion products (fuel/air mix) are burning inside the liner 23. The fuel inlet for the LLI injectors is through the flow sleeve flange 26 at the head/upstream end of the combustor liner 23.

Figure 3B:
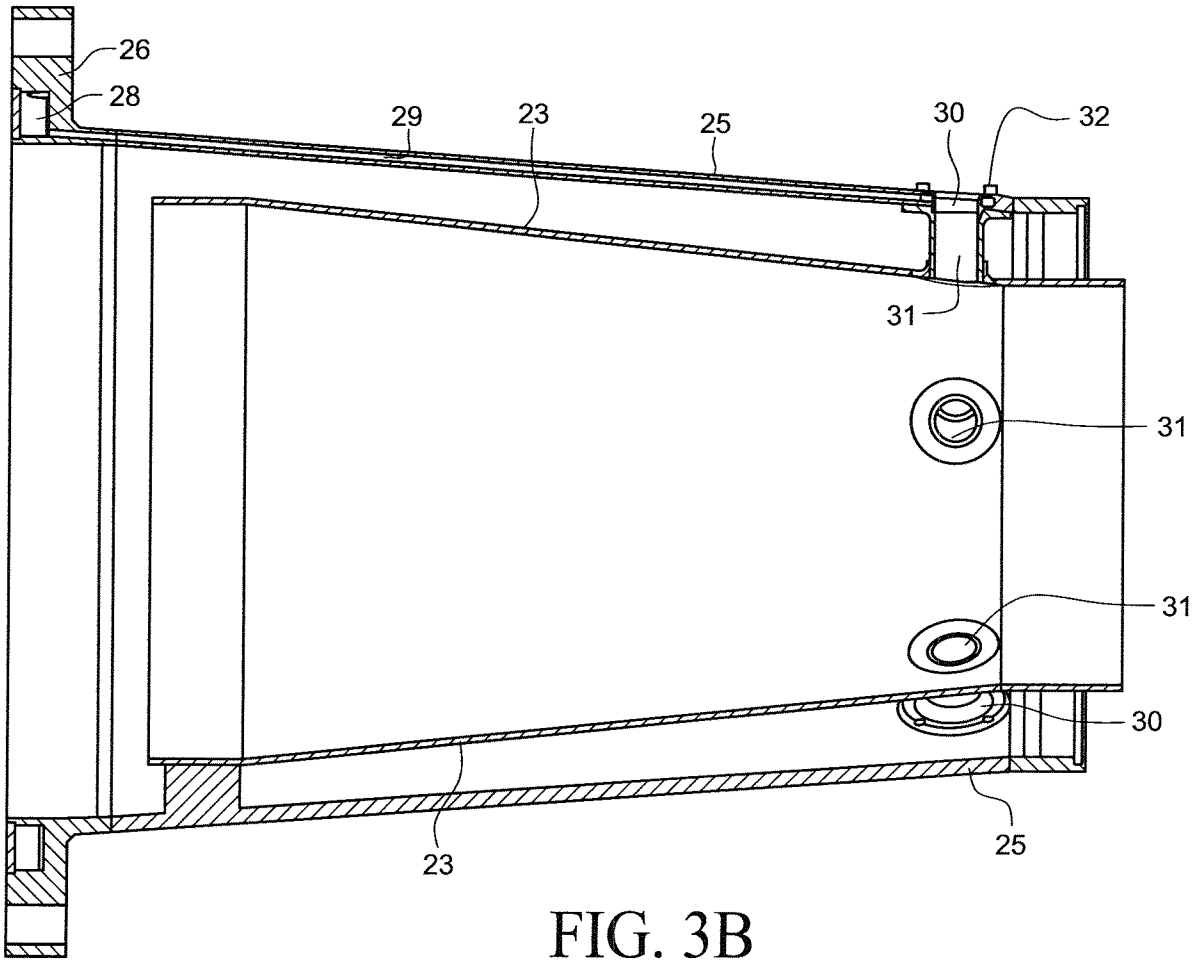

FIG. 3B shows a cross-sectional view of the flow sleeve 25 and liner 23. Fuel flows from at least one fuel ring manifold 28 in the flow sleeve flange 26, through the "gun drilled" long tubes/shafts/holes 29 in the flow sleeve 25, and then to the LLI nozzles/injectors 30, which are constructed like tubes connecting the (outer) flow sleeve 25 to the (inner) liner 23. There are a number of LLI injectors 30 positioned circumferentially around the flow sleeve 25/liner 23 so that a fuel/air mixture is introduced at multiple points around the liner 23. It should be noted that a fuel/air mixture is injected into the liner because in the LLI nozzles, the fuel is injected into air that passes from the CDC cavity into the liner. This air bypasses the head end and participates in the late lean injection. Each of the LLI injectors 30 include a collar in which a number of small holes are formed. Fuel flows from the tubes 29 in the flow sleeve 25 to and through these holes into and through the interior 30 of the tube and into the combustion liner 23. The burning combustion products in the liner 23 ignite the newly introduced fuel/air mixture.

The late lean injection flow sleeve shown in FIGS. 3A and 3B is preferably constructed by first orienting the liner 23 upright, inserting the injectors 30 fully into the liner 23, then inserting the liner into the flowsleeve (flowsleeve cannot fit over liner), aligning the injectors 30 in the liner 23 with clearance holes in flow sleeve 25, and then installing washers and bolts to secure the injectors 30 to the flow sleeve 25. The foregoing parts are joined together as a sub-unit so that they can be installed within the combustor 20 during assembly of the combustor, attaching on one end of the sub-assembly to the CDC and on the downstream end, to the transition piece 24. The head end 22 is then assembled onto the flowsleeve flange and inserts into the liner forward end. It should be noted the assembly locates each component relative to each other axially through the fuel nozzles. In other words, the liner axial position is retained in the combustor via the LLI nozzles and the liner aft end radial position is held via the LLI nozzles (which is unique to the present invention, since traditionally the liner is held axially by lugs and stops on the forward end). This retention allows the LLI nozzles to be in the proper position relative to the liner during all operating conditions.

Referencing FIG. 3B again, it should also be noted that the liner 23 can be a full length liner or a shortened piece that serves as a connector between a traditional liner and the transition piece. This may be used to have a more manageable assembly that can be assembled to the CDC and then the longer, traditional liner can be inserted afterwards. In this embodiment the flow sleeve/connector assembly is bolted onto the CDC and engages the transition piece, then, a traditional liner would be inserted into the connector.

Figure 4A:
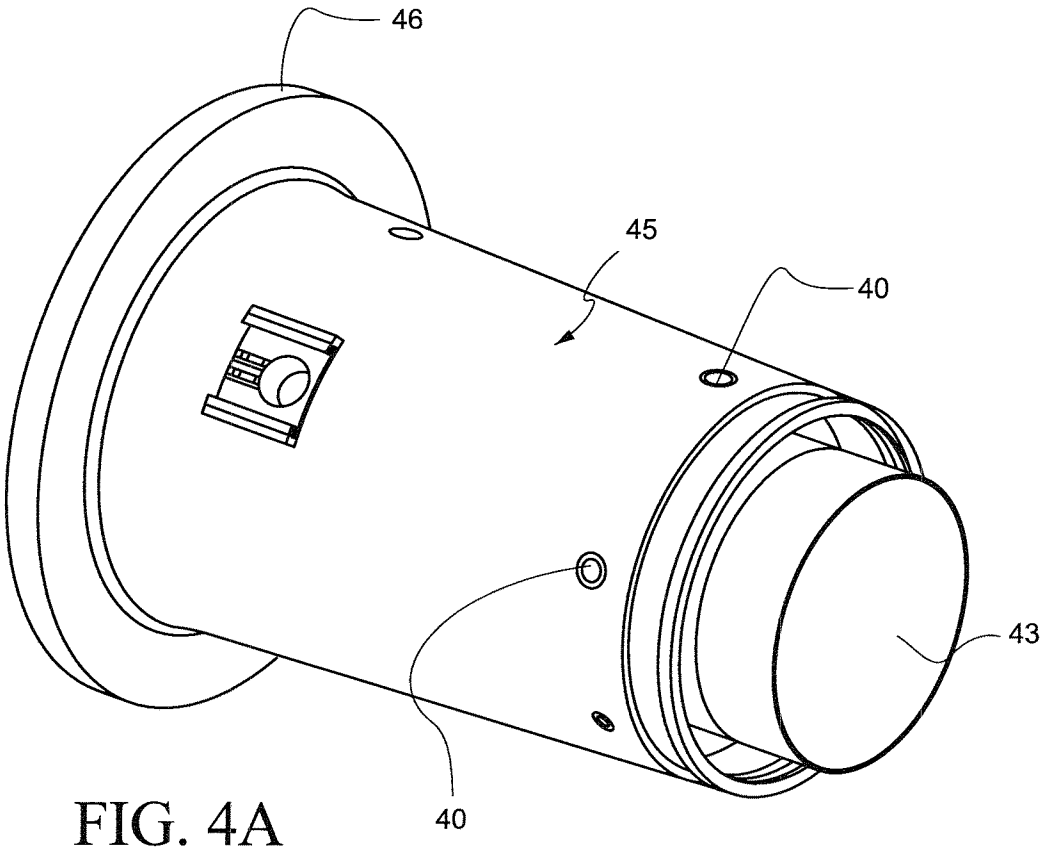
FIGS. 4A to 4F are various perspective and sectional views of a second embodiment of a flow sleeve for the late lean injection of fuel through a combustor liner.
Figure 4B:
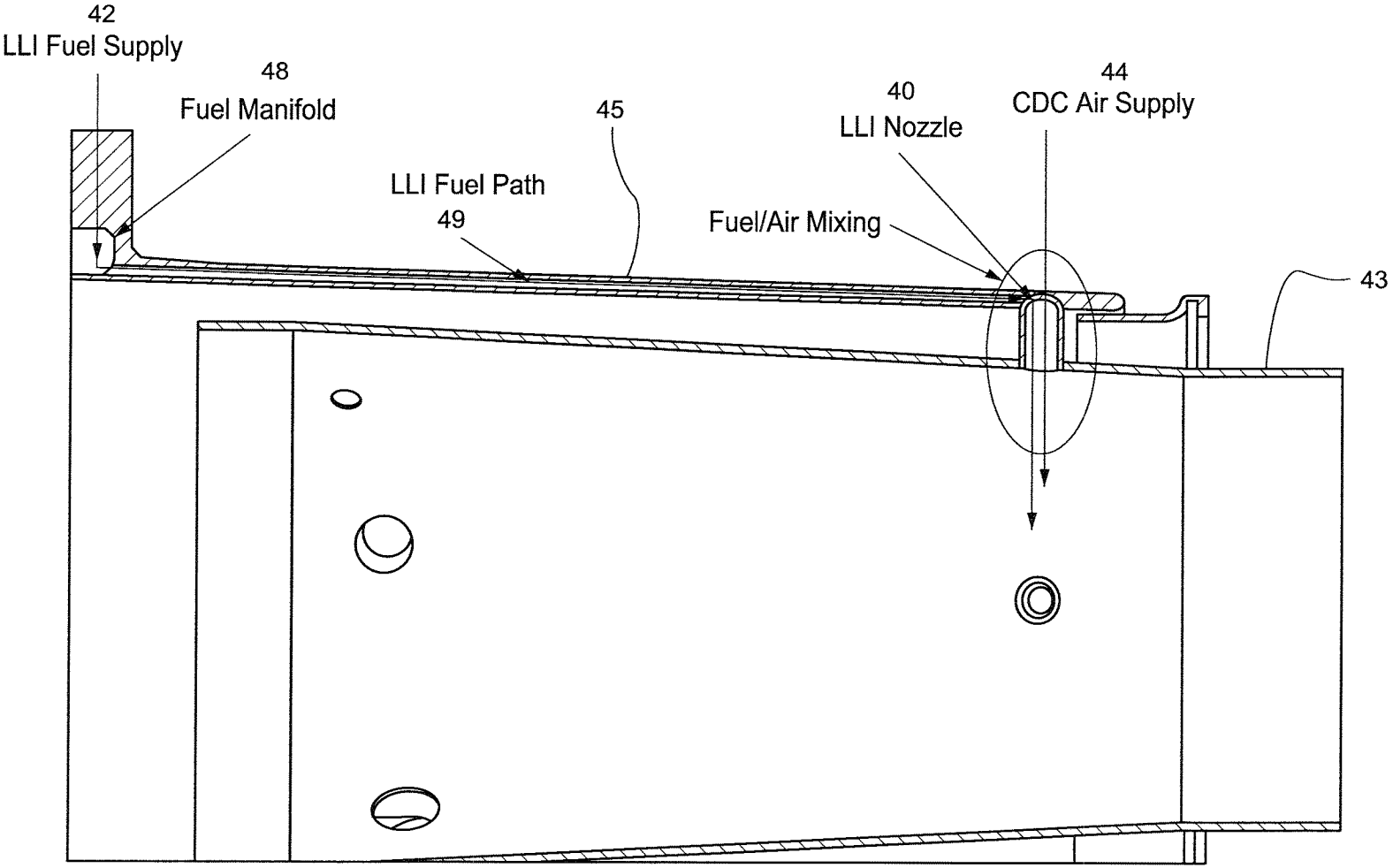
Figure 4D:
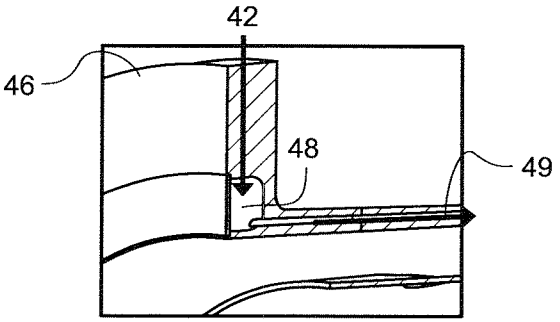
Figure 4F:
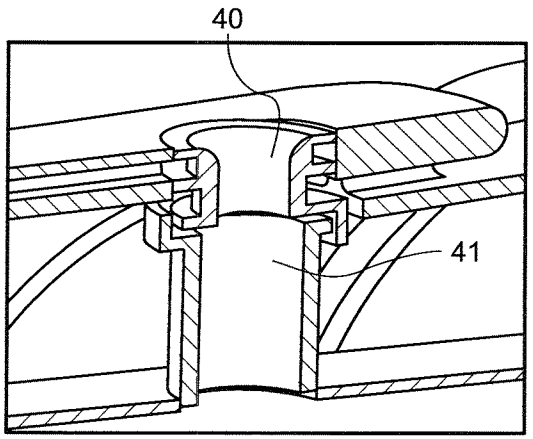
Figure 4C:
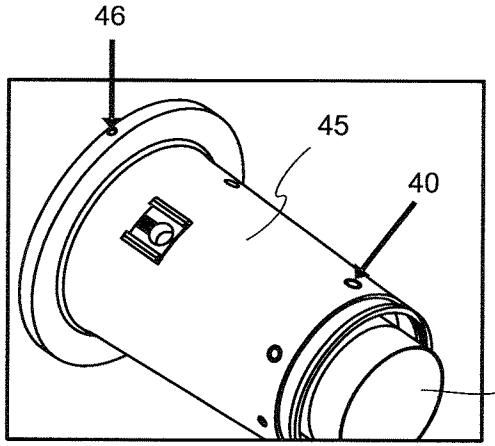
Figure 4E:
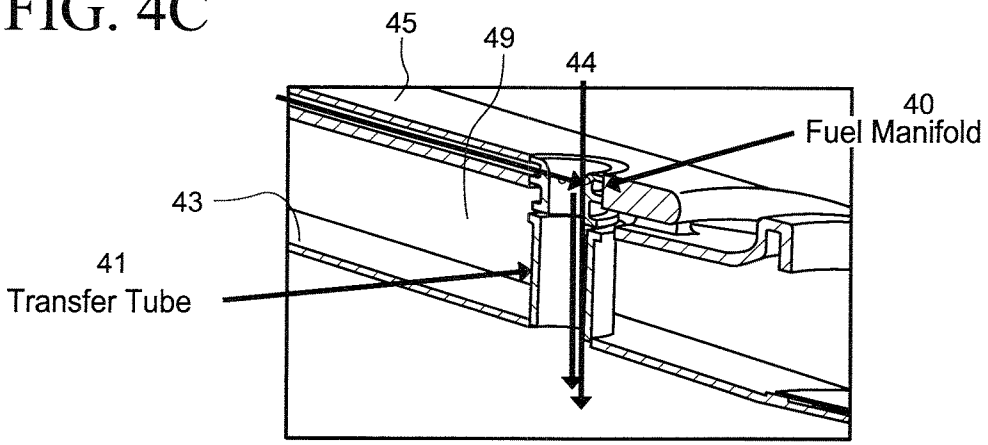

As noted above, FIGS. 4A to 4F are various perspective and sectional views of a second embodiment of a flow sleeve for the late lean injection of fuel through a combustor liner. Specifically, FIGS. 4A and 40 are side perspective views of the second embodiment of a late lean injection flow sleeve 45, but at different points around the circumference of the flow sleeve 45, which, like the embodiment shown in FIGS. 3A and 3B, is used to inject a fuel/air mixture at the aft end of a liner 43, before the transition piece 24. FIG. 4B is a partial cross-sectional view of the flow sleeve 45 and liner 43. FIG. 4D a partial cross-sectional view of flow sleeve flange manifold, while FIGS. 4E and 4F are detailed partial cross-sectional views of the LLI injector.

Like the embodiment shown in FIGS. 3A and 3B, the late lean injection sleeve assembly shown in FIGS. 4A through 4F, combines the traditional liner and flow sleeve assemblies into an assembly with internal fuel manifold and delivery system. The liner 43 and flow sleeve 45 assemblies are combined to provide a single assembly that allows for reduced leakage and improved control of potential fuel leakage. Thus, the late lean injection sleeve assembly shown in FIGS. 4A through 4F operates like the late lean injection sleeve assembly shown in FIGS. 3A and 3B.

As shown in FIGS. 4B and 4D, the fuel 42 required for late lean injection is supplied to the sleeve 43 via at least one ring manifold 48 in the flow sleeve flange 46. As shown in FIG. 4B, at least one feed hole 49 extends longitudinally through the flow sleeve 45, and the fuel 42 flows from the manifold ring 48 through these feed holes 49 to supply fuel to individual LLI nozzles/fuel injectors 40 inserted in the flow sleeve 45. Preferably, the hole extending longitudinally through the flow sleeve is drilled through the flow sleeve, although other constructions, such as molding the holes or forming by inner and outer walls in the feed sleeve, may be used.

The fuel from the feed holes 49 is mixed in the nozzles/fuel injectors 40 with air from the CDC air supply 44 and injected into the liner 43. As can be seen in detailed FIGS. 4E and 4F, each of the individual LLI nozzles/fuel injectors 40 includes a collar in which a number of small holes are formed, whereby fuel flowing from the tubes 29 in the flow sleeve 45 to flows through these holes into and through the interior of the nozzles/injectors 40 and into the combustion liner 43. As can be seen in FIGS. 4B, 4E and 4F, the nozzles/injectors 40 are joined to a transfer tube 41 to transfer the fuel in the flow sleeve 45 and the air from the CDC air supply entering the nozzles/injectors 40 into the liner 43. The nozzles/injectors 40 and transfer tube 41 together span between the flow sleeve 45 and liner 43 assemblies, providing a central core of late lean injection without air losses and potential fuel leakages. The burning combustion products in the liner 23 ignite the fuel newly introduced through the nozzles/injectors 40. And, here again, the number of nozzles/injectors 40 can be varied, depending on the fuel supply requirement. Also, different types of LLI nozzles can be used in the present invention, since it is not specific to fuel nozzles.

The late lean injection flow sleeve 45 shown in FIGS. 4A through 4F is preferably constructed substantially in the same manner as the late lean injection flow sleeve 25 shown in FIGS. 3A through 3B. In the embodiment shown in FIGS. 4A through 4F, the nozzles/injectors 40 are first fully inserted into holes in the flow sleeve 45, after which the liner 43 is inserted into the flow sleeve 45 so as to align the nozzles/injectors 40 in the flow sleeve 45 with clearance holes in the liner 43. In this embodiment, the nozzles/injectors 40 are not secured by washers and bolts to the flow sleeve 45. Rather, the nozzles/injectors 40 and the flow sleeve 45 are provided with complimentary interlocking flanges which serve to secure the nozzles/injectors 40 to the flow sleeve 45 where they are inserted into the flow sleeve 45. Here again, the foregoing parts are joined together as a sub-unit so that they can be installed within the combustor 20 during assembly of the combustor, attaching on one end of the sub-assembly to the CDC. The head end 22, which contains the upstream premixing nozzles 21, and on the downstream end, to the transition piece 24. Again, the head end 22 is then assembled onto the flow sleeve flange 46 and inserts into the liner 43 forward end. Again, it should be noted the assembly locates each component relative to each other axially through the fuel nozzles, such that the liner axial position is retained in the combustor via the LLI nozzles and the liner aft end radial position is held via the LLI nozzles, both these features being unique to the present invention because traditionally the liner is held axially by lugs and stops on the forward end. The foregoing retention arrangement allows the LLI nozzles to be in the proper position relative to the liner during all operating conditions.

Thus, the late lean injection sleeve assemblyn shown in FIGS. 4A to 4F allows the injection of fuel/air mixture at the aft end of a gas turbine liner, before the transition piece, into the combustion gases downstream of the fuel nozzles. The late lean injection enables fuel injection downstream of the fuel nozzles to create a secondary/tertiary (with quaternary injection upstream of the fuel nozzles) combustion zone, while reducing/eliminating the risk of fuel leaking into the combustor discharge case. The fuel is delivered by the flow sleeve 45 into a nozzle 40 that mixes it with CDC air before injecting it into the liner. The design of the present invention allows for easy, low cost implementation of staged combustion to the aft end of the liner assembly. It is easily retrofitted into existing units and is easily installed into new units. It reduces the risk of fuel leaking into the CDC compartment by not having any non-welded interfaces.

Figures 5A, 5B:
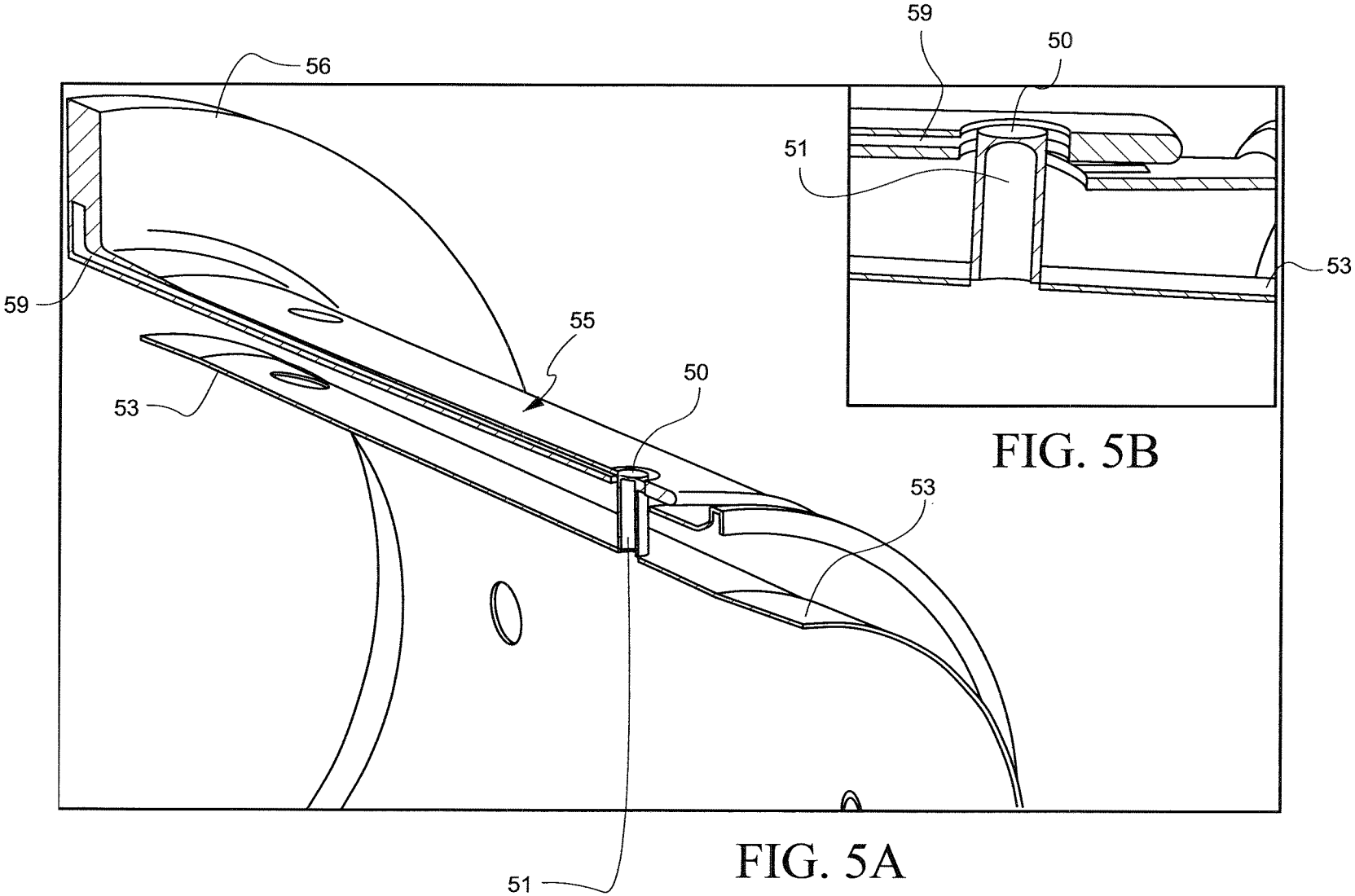
FIGS. 5A and 5B are two sectional views of a third embodiment of a flow sleeve for the late lean injection of fuel into a combustor liner.

As noted above, FIGS. 5A and 5B are two sectional views of a third embodiment of a late lean injection sleeve assembly for the late lean injection of fuel into a combustor liner. The embodiment of FIGS. 5A and 5B is constructed and functions substantially like the embodiments shown in FIGS. 3A and 3B and in FIGS. 4A through 4F. However, in the embodiments of FIGS. 3A and 3B and FIGS. 4A through 4F, the components (i.e., the liner, flow sleeve, and injectors) are separate from one another. In the embodiment of FIGS. 5A and 5B, the components are assembled into a single component or sub-unit with an internal fuel manifold and delivery system, which is installed during assembly of the combustor.

Figure 6A:
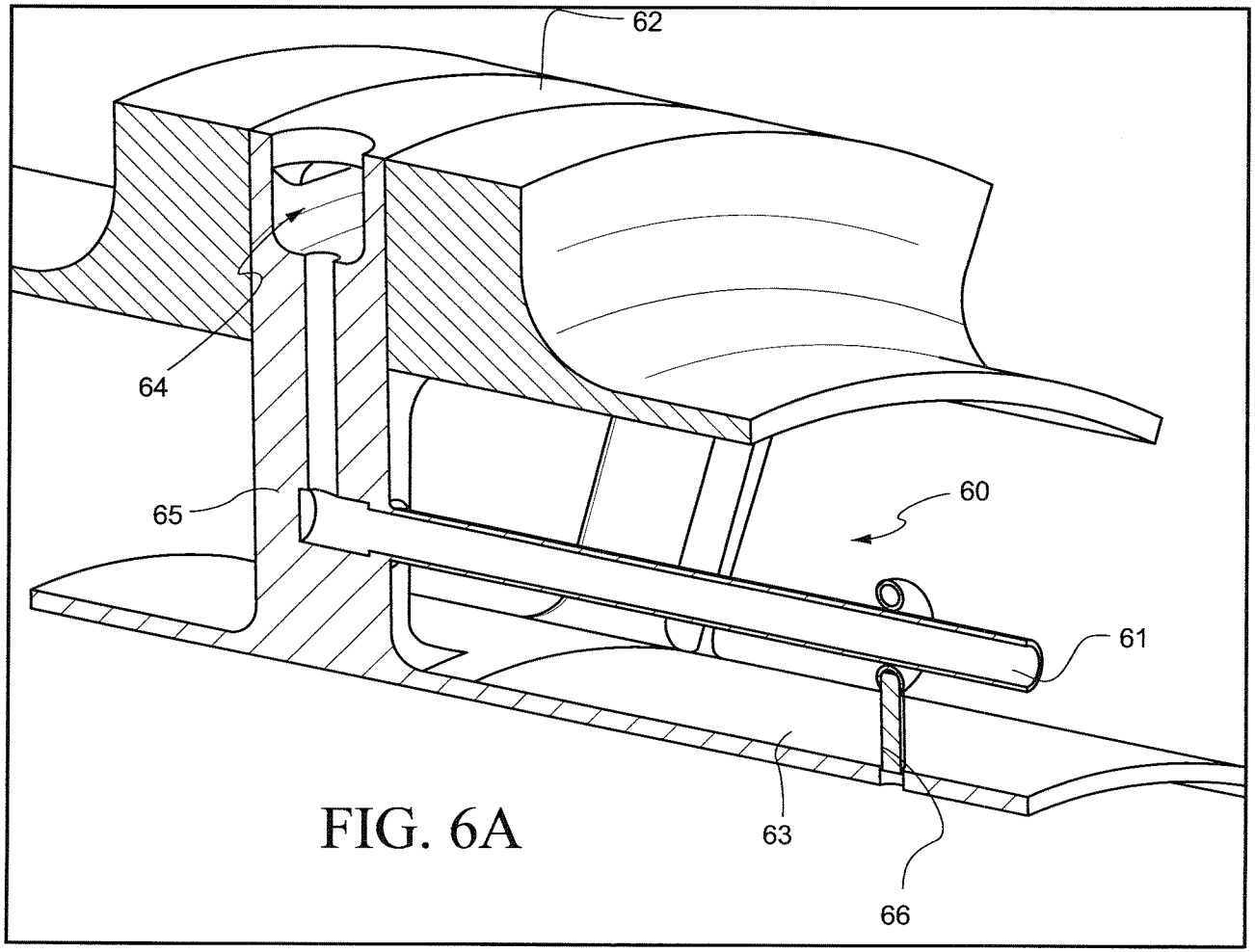
FIGS. 6A and 6B are two partial perspective and sectional views of a late lean injection assembly that is integrated into the combustion liner assembly of a turbine combustor, so as to combine the traditional combustion liner with an integrated fuel delivery system.
Figure 6B:
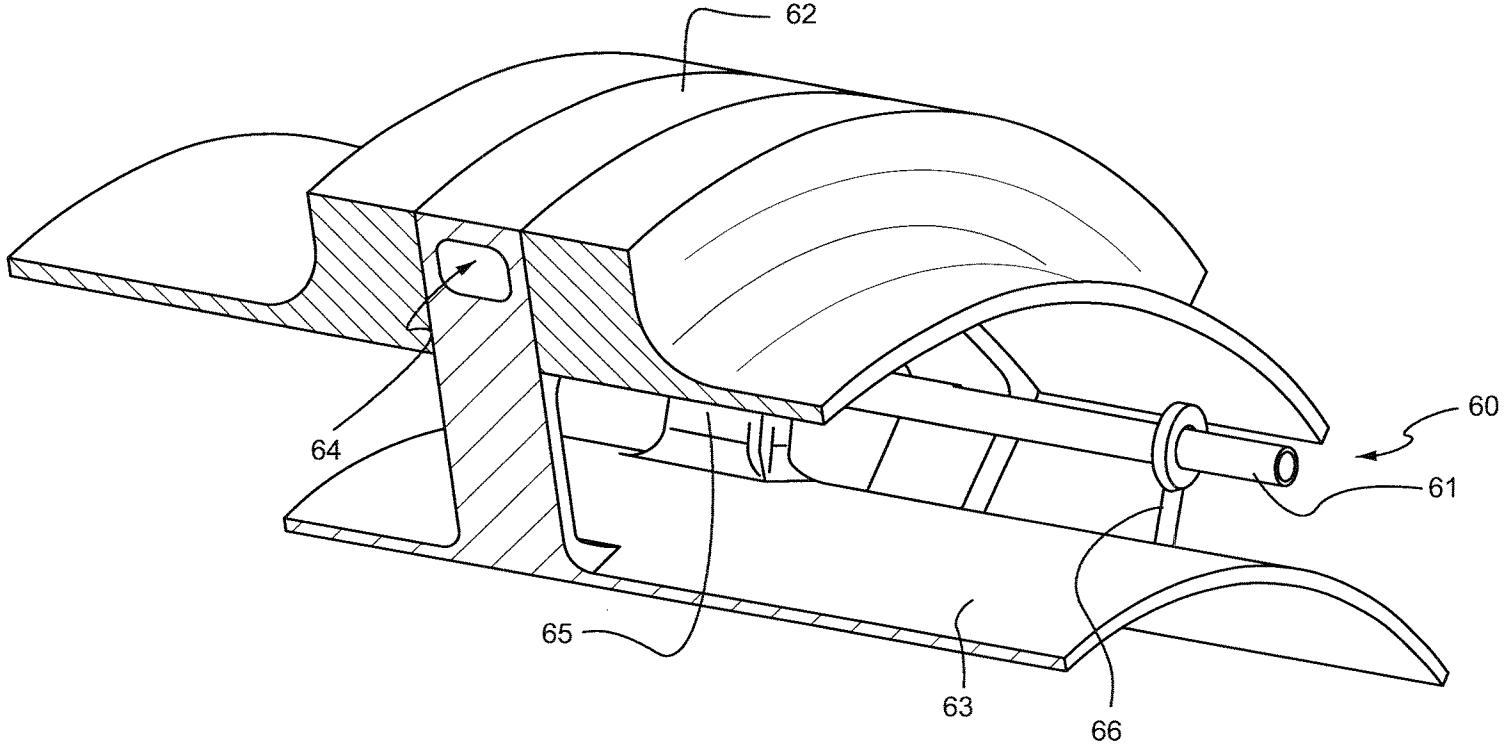

FIGS. 6A and 6B are two partial perspective and sectional views of a late lean injection assembly 60 that is integrated into the combustion liner assembly 63 of a turbine combustor, so as to combine the traditional combustion liner with an integrated fuel delivery system. The design is a single assembly that is installed during unit assembly. The design has a forward flange 62 that is used for both support and to feed the fuel to the injection tubes or nozzles. The design can use any means of transferring fuel from a manifold flange 62 along the outside of the liner 63 to the nozzles inserted in the liner 63, like the nozzles 30 shown in FIG. 2, at the aft end of the liner 63. Preferably at least one conduit is used to transfer fuel from the manifold flange 62. Preferably, the fuel is supplied to an internal manifold in the forward flange 62 and is then delivered to axial running conduits in the form of tubes 64 through passages in struts 65. The number and orientation of the struts 65 can be varied, depending on the amount of late lean injection that is required. The axial running tubes 64 are supported along the length of the liner 63 by tube struts 66 that are welded to the body of liner 63. This interface is designed to minimize wear between the tube struts 66 and the tubes 61. It should be noted that the struts can be replaced with tubes that have a bend (such as a 90 degree bend) and that have fittings for attaching into the manifold 64 in flange 62.

The integrated late lean injection assembly 60 on a combustion liner 63 provides a simple low cost option for late lean injection. This assembly is easily retrofitted on existing combustor units and can be installed at a lower cost than current late lean injection designs. The assembly 60 is a single assembly that is installed during combustor unit assembly. The late lean injection assembly 60 addresses the mechanical system to feed fuel to the second stage of combustion and does not address the actual injection of fuel. The late lean injection assembly 60 is easily retrofitted on existing units and can be installed for a fraction of the cost of current designs.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An assembly for the late lean injection of fuel into a gas turbine combustor, the assembly comprising:

a liner connected between a head end and a transition piece of the combustor, the liner defining a combustion zone of the combustor, a flow sleeve surrounding the liner and being concluded by the transition piece, the flow sleeve having at least one passage extending longitudinally through the flow sleeve, wherein the at least one passage is formed within, so as to be defined by the interior of, the flow sleeve wall, at least one nozzle inserted in the flow sleeve and extending to the liner, wherein, fuel flowing through the at least one passage extending longitudinally through the flow sleeve is fed into the at least one nozzle, mixed with CDC air, and injected into the liner for combustion therein.

2. The assembly of claim 1, wherein the at least one passage is a plurality of holes extending longitudinally through the flow sleeve.

3. The assembly of claim 2, wherein each of the plurality of holes extending longitudinally through the flow sleeve is drilled through the flow sleeve.

4. The assembly of claim 1, wherein the flow sleeve includes a flange within which is at least one ring manifold through which fuel is fed to the at least one longitudinal passage in the flow sleeve.

5. The assembly of claim 1, wherein each of the at least one nozzles includes a collar in which a number of small holes are formed, whereby fuel flowing from the at least one longitudinal passage into the at least one nozzle flows through these small holes into and through the interior of the nozzle, is mixed with air and injected into the combustion liner.

6. The assembly of claim 5, wherein each of the at least one nozzles is joined to a transfer tube to transfer the fuel in the flow sleeve and air mixed with the fuel at the injector into the liner.

7. The assembly of claim 6, wherein each of the at least one nozzles and its corresponding transfer tube together span between the flow sleeve and the liner.

8. The assembly of claim 1 comprising a plurality of nozzles inserted in the flow sleeve and extending to the liner.

9. The assembly of claim 8, wherein the number of nozzles inserted in the flow sleeve is varied, depending on the fuel supply requirement.

10. The assembly of claim 8, wherein the plurality of nozzles are positioned around the circumference of the flow sleeve and the liner.

11. The assembly of claim 1, wherein each of the at least one nozzles is secured to the flow sleeve by bolts or bolts in combination with washers.

12. The assembly of claim 1, wherein each of the at least one nozzles is secured to the flow sleeve by complimentary interlocking flanges on the nozzle and the flow sleeve.

13. The assembly of claim 1, wherein burning combustion products in the liner ignite the fuel/air mixture introduced into the liner through the at least one nozzle.

14. The assembly of claim 1, wherein the fuel fed from the at least one longitudinal passage to the at least one nozzle is mixed in the nozzle with air prior to injection in the liner.

15. The assembly of claim 14, wherein the air mixed with the fuel in the at least one nozzle is from the compressor discharge case ("CDC") air supply.

16. The assembly of claim 1, wherein the liner, flow sleeve, and the at least one injector are separate components from one another.

17. The assembly of claim 1, wherein the liner, flow sleeve, and the at least one injector are assembled into a single unit, which is installed during assembly of the combustor.

18. The assembly of claim 1, wherein the late lean injection by the at least one injector of fuel in the liner downstream of fuel nozzles in the head end of the combustor creates at least a secondary combustion zone for improving the combustor' s NOX performance.

19. The assembly of claim 18, wherein the late lean injection by the at least one injector of fuel in the liner creates secondary and tertiary combustions zones in the liner where the combustor includes quaternary injection upstream of the fuel nozzles in the head end of the combustor.

20. The assembly of claim 8, wherein the plurality of nozzles inserted in the flow sleeve and extending to the liner is a plurality of injectors.

21. The assembly of claim 1, wherein the at least one passage in the flow sleeve is formed by the flow sleeve body having co-annular walls with the at least one passage in between the co-annular walls.

22. A late lean injection assembly which is integrated into a combustion liner of a gas turbine combustor, so as to combine a traditional combustion liner with an integrated fuel delivery system, the late lean injection assembly comprising:

at least one nozzle inserted into the combustion liner, at least one tube extending along the combustion liner, the at least one tube directing fuel to the least one nozzle, and a flange that supports and feeds fuel to the at least one tube, wherein, fuel flowing through the at least one tube and directed into the at least one nozzle, is mixed with air in the nozzle and injected into the liner for combustion in a secondary combustion zone formed in the liner.

23. The late lean injection assembly of claim 22, wherein the at least one nozzle is at least one injector.

24. A late lean injection assembly which is integrated into a combustion liner of a gas turbine combustor, so as to combine a traditional combustion liner with an integrated fuel delivery system, the late lean injection assembly comprising:

at least one nozzle inserted into the combustion liner, at least one conduit extending along the combustion liner, the at least one conduit directing fuel to the least one nozzle, and a flange that supports and feeds fuel to the at least one conduit, wherein, fuel flowing through the at least one conduit and directed into the at least one nozzle, is mixed with air in the nozzle and injected into the liner for combustion in a secondary combustion zone formed in the liner, and at least one flange strut extending between the flange and the at least one conduit, and wherein the flange includes an internal manifold which supplies fuel to the at least one conduit through the at least one flange strut.

25. The late lean injection assembly of claim 24 further comprising a plurality of conduits that are tubes and a plurality of struts.

26. The late lean injection assembly of claim 25, wherein the number and orientation of the tube and struts is varied, depending on the amount of late lean injection that is required.

27. The late lean injection assembly of claim 25, wherein the plurality of tubes are running along the length of the liner and are supported along the length of the liner by a plurality of tube struts welded to the liner.

28. A late lean injection assembly which is integrated into a combustion liner of a gas turbine combustor, so as to combine a traditional combustion liner with an integrated fuel delivery system, the late lean injection assembly comprising:

at least one nozzle inserted into the combustion liner, at least one conduit extending along the combustion liner, least one conduit directing fuel to the least one nozzle, and a flange that supports and feeds fuel to the at least one conduit, wherein, fuel flowing through the at least one conduit and directed into the at least one nozzle, is mixed with air in the nozzle and injected into the liner for combustion in a secondary combustion zone formed in the liner.

and wherein, the flange includes an internal manifold which supplies fuel to at least one injection tube, the at least one injection tube having a bend and fittings for attaching into the manifold in the flange.

29. The late lean injection assembly of claim 28, wherein the tube has a 90 degree bend.

* * * * *

UNITED STATES PATENT AND TRADEMARK OFFICE

CERTIFICATE OF CORRECTION

PATENT NO. : 8,601,820 B2
APPLICATION NO. : 13/153944
DATED : December 10, 2013
INVENTOR(S) : Byrne et al.

It is certified that error appears in the above-identified patent and that said Letters Patent is hereby corrected as shown below:

In the Specification

Column 2, line 63, insert --20-- after “The combustor” and before “(combustor 14”

Column 4, line 29, change “4A and 40” to --4A and 4C--

Column 5, line 46, change “assemblyn” to --assembly--

Column 6, line 21, insert --64-- after “internal manifold” and before “in”

In the Claims:

In Claim 28, column 8, line 56, insert --the at-- before “least one”

Signed and Sealed this
Fourth Day of March, 2014

Michelle K. Lee

Michelle K. Lee
*Deputy Director of the United States Patent and Trademark Office*